US010702446B2

(12) United States Patent
Drath et al.

(10) Patent No.: US 10,702,446 B2
(45) Date of Patent: Jul. 7, 2020

(54) SPINE EXTENSION ROLLER

(71) Applicants: Thomas Walter Drath, Phoenix, AZ (US); Daniel Albert Drath, Phoenix, AZ (US)

(72) Inventors: Thomas Walter Drath, Phoenix, AZ (US); Daniel Albert Drath, Phoenix, AZ (US)

( * ) Notice: Subject to any disclaimer, the term of this patent is extended or adjusted under 35 U.S.C. 154(b) by 392 days.

(21) Appl. No.: 15/142,311

(22) Filed: Apr. 29, 2016

(65) Prior Publication Data

US 2017/0312168 A1 Nov. 2, 2017

(51) Int. Cl.
*A61H 15/00* (2006.01)
*A61H 1/02* (2006.01)

(52) U.S. Cl.
CPC ..... *A61H 15/00* (2013.01); *A61H 1/0292* (2013.01)

(58) Field of Classification Search
CPC .. A61H 1/005–02; A61H 1/0292–0296; A61H 7/00–005; A61H 7/007; A61H 2007/009; A61H 15/00–02
See application file for complete search history.

(56) References Cited

U.S. PATENT DOCUMENTS 3,750,654 A 8/1973 Shiu
4,716,891 A 1/1988 Yorgan
4,832,006 A 5/1989 Kirsch
5,038,757 A * 8/1991 Yamasaki ..... A61G 7/05 601/102
5,348,529 A * 9/1994 Veltri ..... A61H 1/00 297/260.1
5,577,995 A 11/1996 Walker et al.
5,772,614 A * 6/1998 Lindquist ..... A63B 21/00196 601/116
5,848,980 A * 12/1998 Demerais ..... A61H 23/02 601/46
5,935,090 A * 8/1999 Kennon ..... A61H 7/00 601/134
6,056,709 A * 5/2000 Hashimoto ..... A61H 15/0078 601/118
6,315,742 B1 * 11/2001 Howard ..... A61H 15/0092 601/125
6,589,192 B2 7/2003 Chan et al.
6,648,904 B2 * 11/2003 Altshuler ..... A46B 15/0036 492/46
D700,709 S 3/2014 Khodabakhshian
2004/0127823 A1 * 7/2004 Mori ..... A61H 1/00 601/99
2005/0215928 A1 9/2005 Banks et al.
(Continued)

FOREIGN PATENT DOCUMENTS

EP 2 604 243 6/2013
WO WO 96/00555 1/1996

*Primary Examiner* — Rachel T Sippel
(74) *Attorney, Agent, or Firm* — Venjuris, P.C.

(57) ABSTRACT

The invention is embodied in an apparatus for extending the human back. The preferred apparatus has a frame of transverse and longitudinal members, and a roller 20 rigidly supported from below by a transverse member. The space above the roller and frame is open so that a user can lie face up on the roller and grab the longitudinal members with each hand to extend the back over the top of the roller. The user then lowers his hips to extend the spine as much as desired. The user can roll the spine, vertebrae by vertebrae, from the base of the occipital to the sacrum.

7 Claims, 7 Drawing Sheets

(56) References Cited

U.S. PATENT DOCUMENTS

| | | | | |
|---|---|---|---|---|
| 2006/0084893 | A1* | 4/2006 | Marten | A61H 15/0078 601/118 |
| 2009/0112137 | A1* | 4/2009 | Lamore | A61H 15/00 601/112 |
| 2010/0145243 | A1 | 6/2010 | Kantor | |
| 2014/0336022 | A1 | 11/2014 | Jones | |
| 2015/0257969 | A1* | 9/2015 | Shannon | A61H 15/00 601/121 |
| 2016/0022529 | A1* | 1/2016 | Abdo | A61H 15/00 601/119 |
| 2016/0129302 | A1* | 5/2016 | Vallo | A61H 15/00 482/132 |
| 2017/0231862 | A1* | 8/2017 | Olschansky | A61H 15/0092 601/128 |

* cited by examiner

SPINE EXTENSION ROLLER

FIELD OF THE INVENTION

The present invention relates to rolling and extending the spine.

BACKGROUND

Foam rolling is a common technique and its benefits are well known. When foam rolling the back, a user will lie face up on a cylindrically-shaped foam roller with the roller oriented to roll lengthwise along the spine. The user may use the feet to assist moving the spine lengthwise over the foam roller. (See, e.g., FIG. 1.) While the benefits of foam rolling the back in this way are tangible, they are limited because a user's weight is distributed along the length of the roller. Once the user's body adjusts to the user's weight on the roller the benefits, while still tangible, diminish over time.

What is needed is an improved spine roller that can load the facet joints more directly and to a greater degree in order to provide additional benefits to a user beyond what the user could do with a foam roller alone.

SUMMARY OF THE INVENTION

This invention comprises two key elements: (1) the roller and (2) the grab bars. When combined as described herein, the invention provides its user with a more effective method of positively manipulating the spine's facet joints and achieving spinal extension. In addition, this invention allows a user to mobilize the entire length of the spine, from the base of the occipital to the sacrum.

The spatial relationship between the roller and the grab bars allow a user to dynamically increase spinal extension as shown in FIGS. 2-3. By holding on the grab bars while dropping the hips, a user can self-achieve greater levels of facet manipulation, thereby allowing a user more effective results in a shorter period of time. Without grab bars, one simply cannot effectively counterbalance the spinal flexion that is invariably imposed on the human body functioning in a primarily sedentary culture.

The roller/grab bar combination enables a user to re-establish more favorable spinal facet extension in (a) a horizontal closed kinetic chain environment and (b) a non-compressive spinal loading environment (see FIGS. 2-3). This environment provides a user with more control as the user attempts greater range of motion in the facet joints. Typical standing and back-bending environments common in yoga and other practices are performed in open kinetic chain and under spinal load, and with inherently less user control.

BRIEF DESCRIPTION OF THE DRAWINGS OR PICTURES

DETAILED DESCRIPTION

Figure 1:
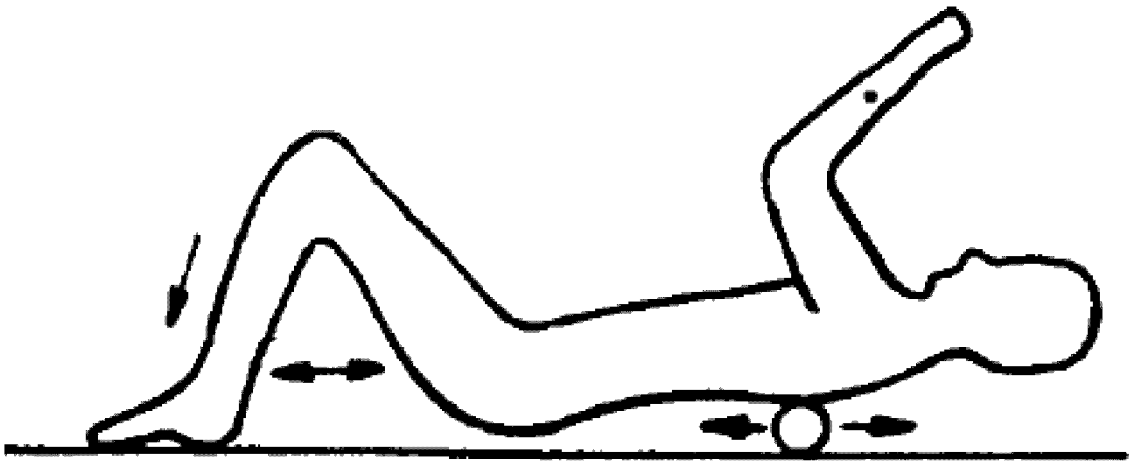
Fig. 1 Prior Art
FIG. 1 illustrates a prior art device.
Figure 2:
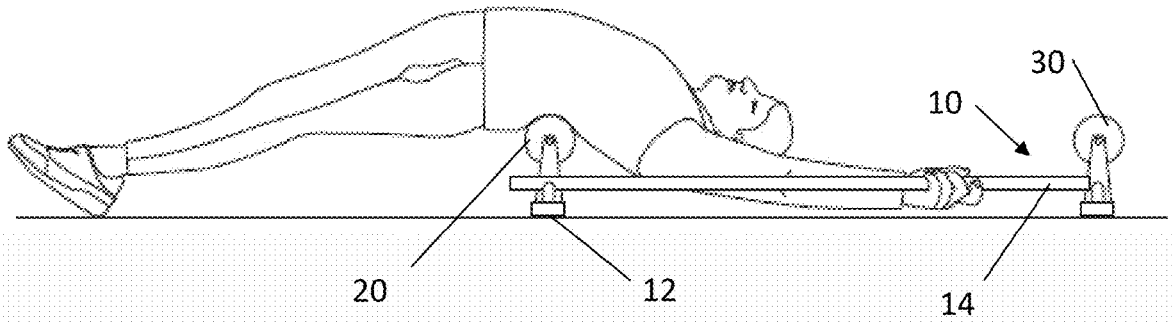
FIG. 2 illustrates a side view of a person using a preferred embodiment of the apparatus 10.
Figure 3:
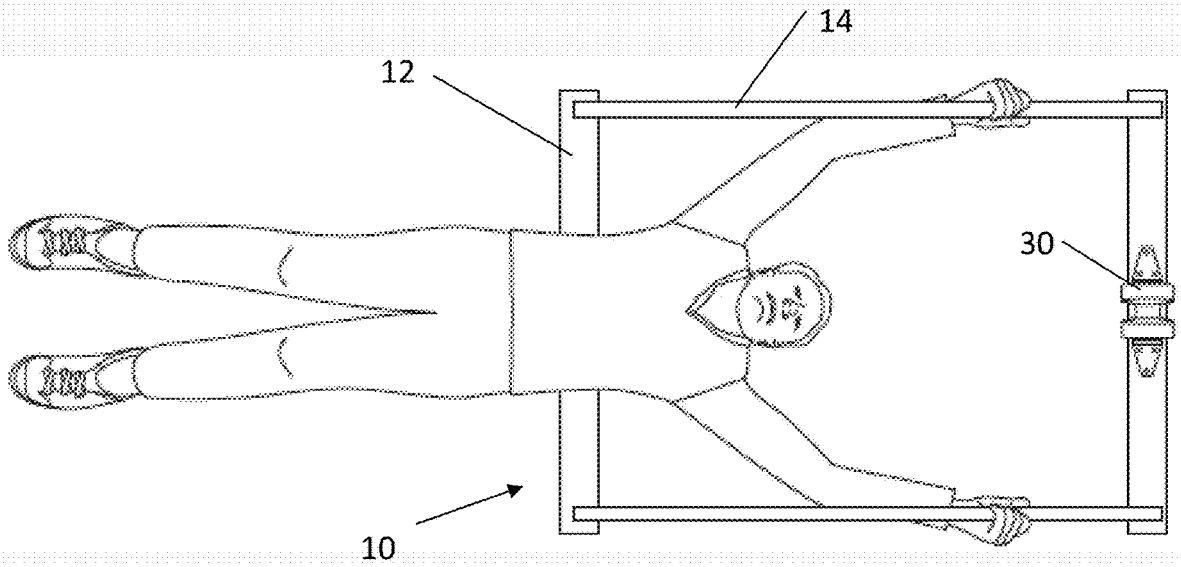
FIG. 3 illustrates of a top view of a person using a preferred embodiment of the apparatus 10.
Figure 4:
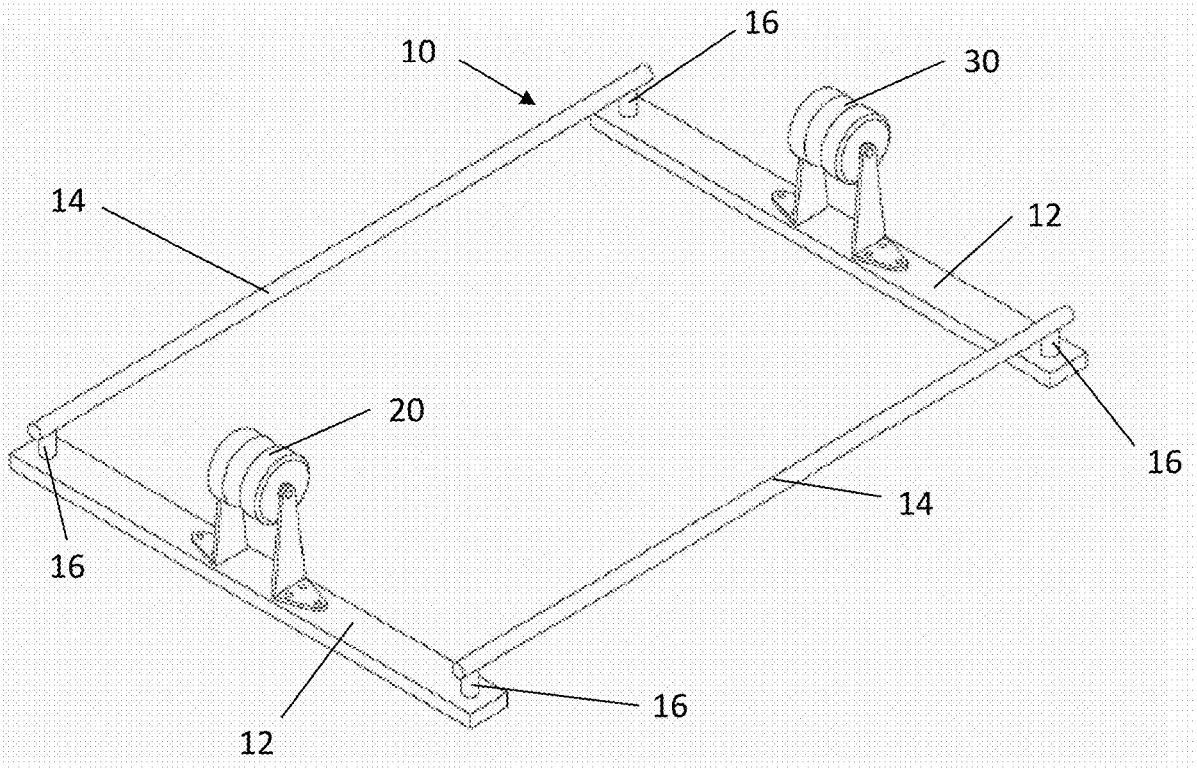
FIG. 4 illustrates a front perspective view of a preferred embodiment of the apparatus 10.

The invention is embodied in an apparatus for extending the human back. As shown in FIGS. 2-9, the preferred apparatus has a frame 10, comprising transverse members 12 and longitudinal members 14. A roller 20 is rigidly supported from below by the transverse member 12. The space above the roller 20 and frame 10 is open so that a user can lie face up on the roller and grab the longitudinal members 14 with each hand to extend the back over the top of the roller as illustrated in FIG. 2-3. The user then lowers his hips to extend the spine as much as desired. The user can roll the spine, vertebrae by vertebrae, from the base of the occipital to the sacrum.

The preferred frame 10 is constructed from steel members bolted together, although welding or most any connection known in the art would suffice. The transverse member 12 is preferably a rectangular tube. The longitudinal members 14 are preferably circular tubes connected to the top sides of transverse members 12 at joints 16. Connecting the longitudinal members 14 to the top sides of the transverse members 12 creates a space under the longitudinal members 14 when the transverse members 12 are resting on the ground or floor. This space allows a user of the apparatus to grab each longitudinal member 14 while using the apparatus. The preferred frame is 48" (inches) by 32". The frame 10 could be collapsible for easy storage if desired. There are many ways to construct a collapsible frame known in the art. One example is to add locking hinges on two of the joints 16 and latches on the remaining two joints 16 so that the frame can be collapse and stored in the collapsed position. Alternatively, one or more of the members, like the longitudinal members, could be a telescoping member so its length could be shortened for easier storage.

The preferred roller 20 is made from polyvinyl chloride (pvc), but any rigid material will work. The roller rotates about an axis substantially perpendicular to the longitudinal members to that a user's hand can travel up and down the longitudinal member as the user moves the length of his or her back over the roller.

The preferred roller 20 has an open channel 22 that runs around the circumference of the roller 20. The channel is oriented substantially parallel to the longitudinal members so that when the user is face-up on the roller 20, the spinous process passes through the open channel and the surface 21 of roller 20 rest over the facet joints, not on the spinous process part of the vertebrae.

The dimensions of the roller can vary greatly to suit a user's preference, but a roller 20 between 2" (inches) and 6" in diameter, and preferably between 3.5" and 4.5", has been found to work well. Likewise, a channel 22 having width 24 that is 1" wide and a depth of 1" deep is preferable. A roller width 26 on either side of the channel that is preferably 1.5" wide has been found to work well. The preferable height 28 between the top of the roller and the floor is between 3" and 12" with 8" being most preferred.

The preferred roller spins on a shaft 32. The shaft 32 is supported on either end by vertical members 34. The vertical members 34 are connected to the frame 10, preferably by welding, but other connections like bolting as shown in FIG.

Figure 5:
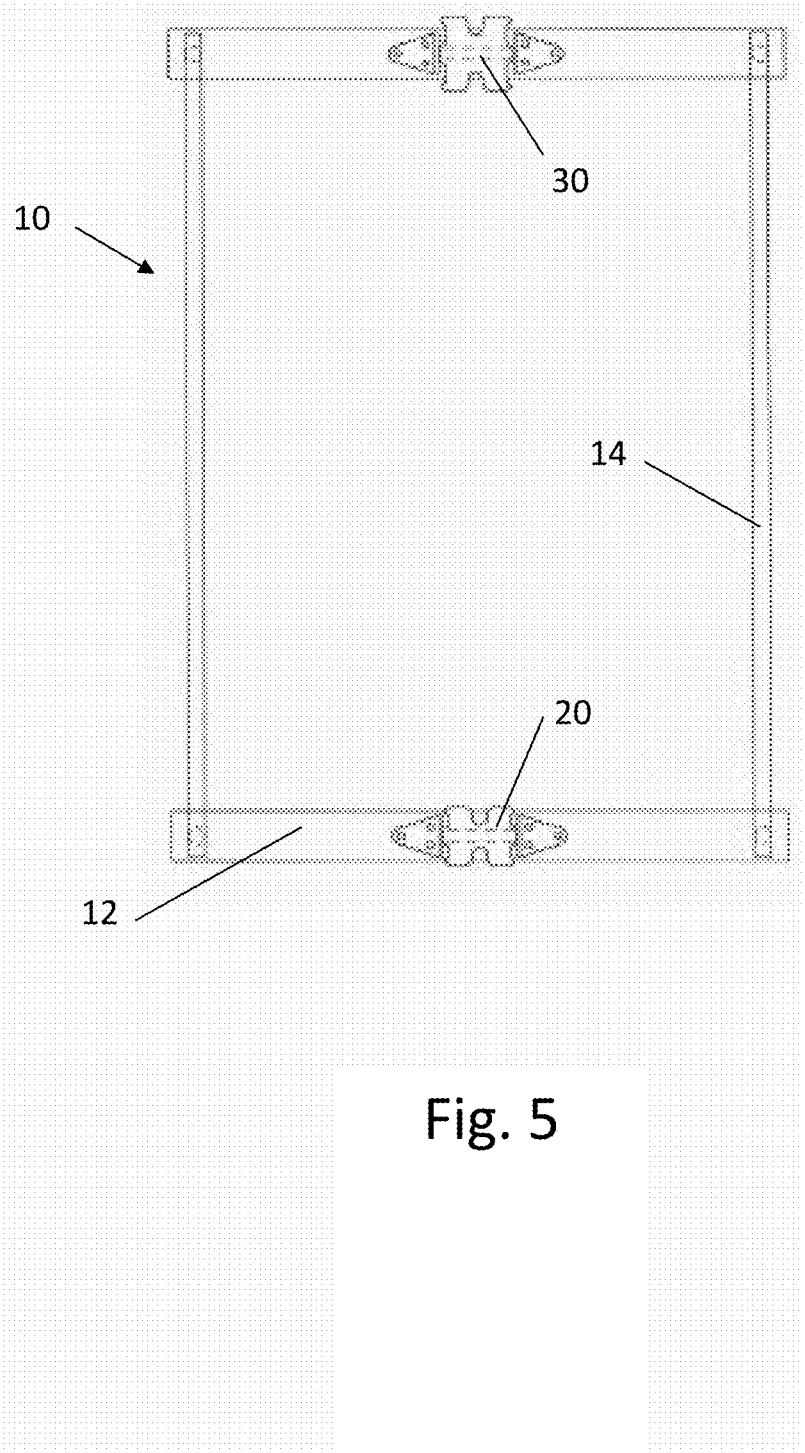
FIG. 5 illustrates a top view of a preferred embodiment of the apparatus 10.
Figure 6:
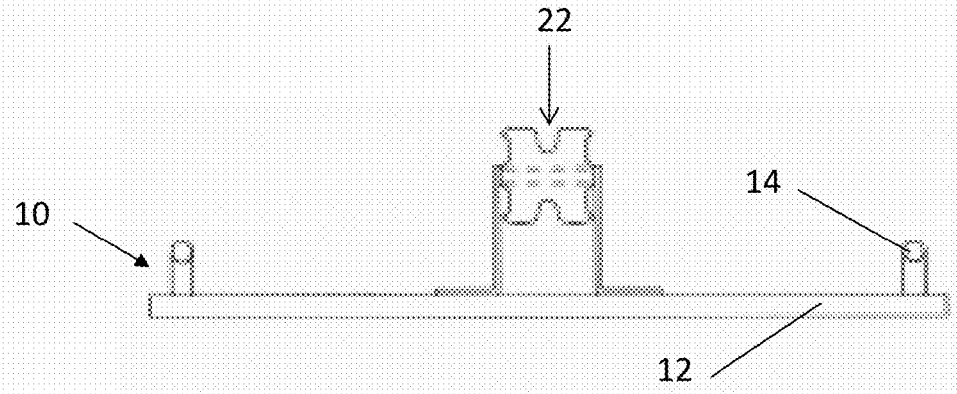
FIG. 6 illustrates a side view of a preferred embodiment of the apparatus 10.
Figure 7:
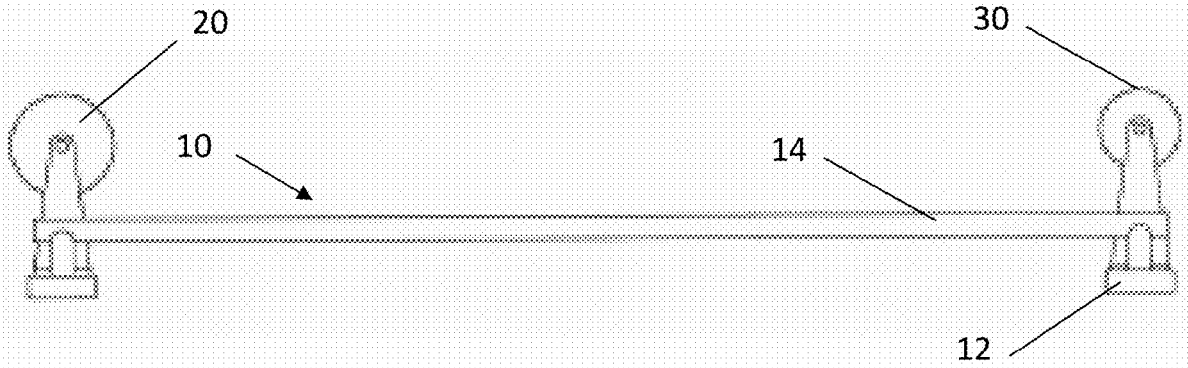
FIG. 7 illustrates a side view of a preferred embodiment of the apparatus 10.
Figure 8:
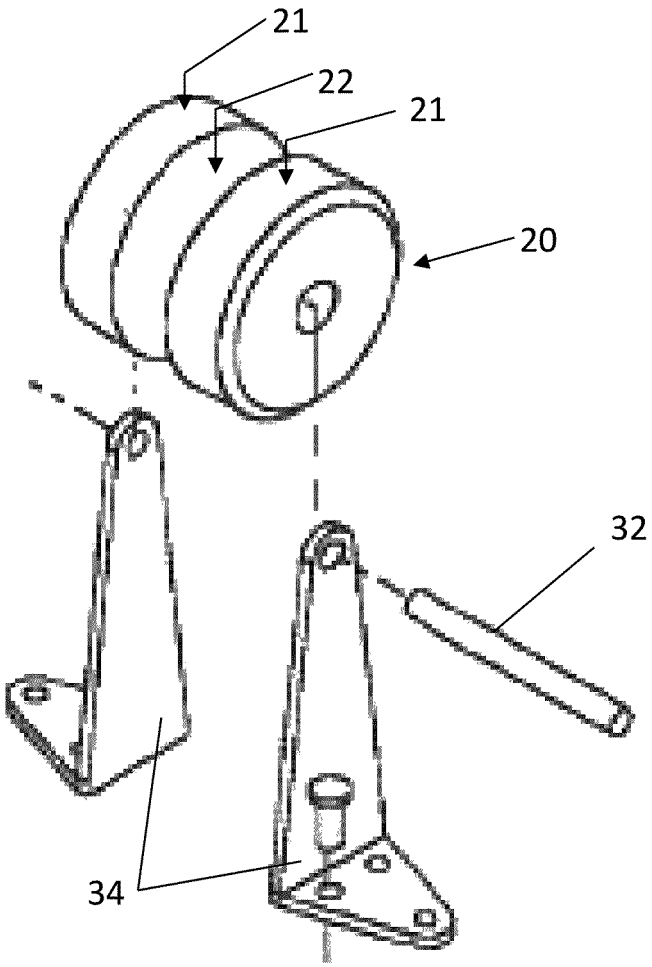
FIG. 8 illustrates an exploded view of a preferred roller assembly.
Figure 9:
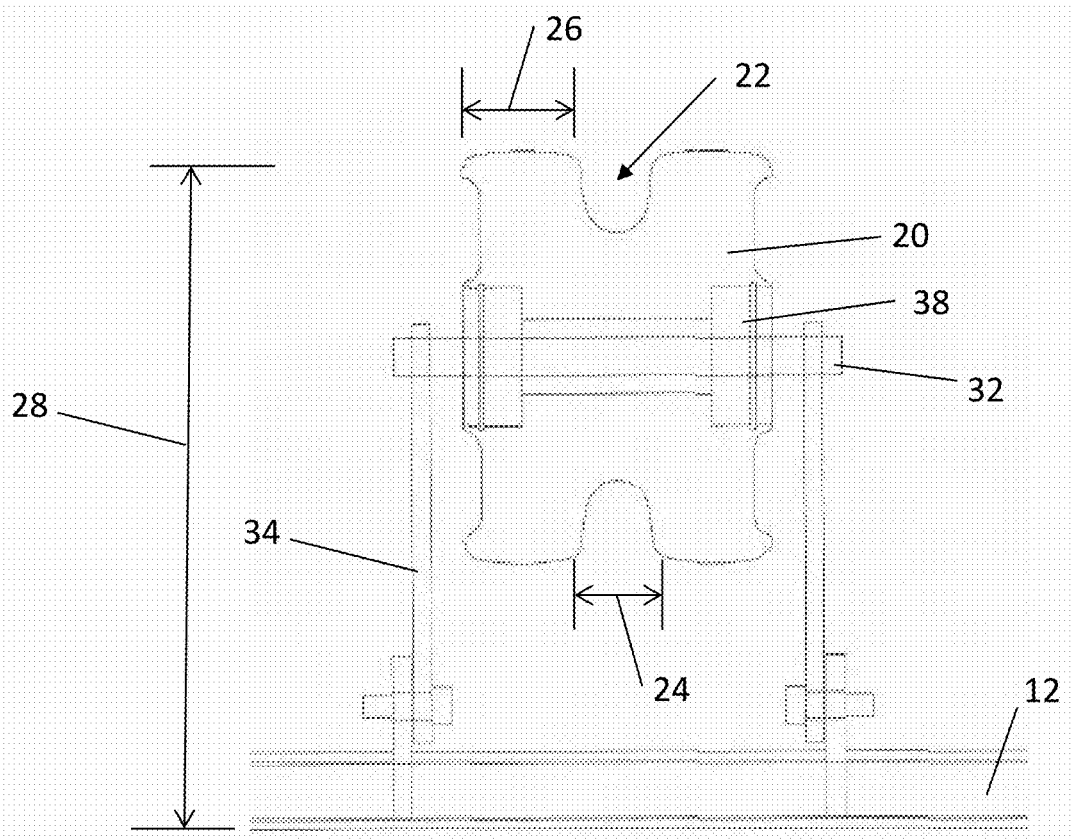
FIG. 9 illustrates a front view of an embodiment of a roller assembly.

8 are suitable. As shown in FIG. 5, the vertical members 34 are preferably connected to the middle of transverse member 12 so that the roller 20 is centered between the longitudinal members 14. Optionally, on a pair of roller bearings 38 can be added but have been found unnecessary.

Additionally, the width of the roller 10 allows a user to mobilize the body's scapula. All of these elements of the spine are associated with the idea of movement within each segment of the spine. This is important for reasons of optimally nourishing the spinal disks, while also allowing the appropriate levels of innervation throughout the entire body that begins at each segment of the vertebra.

An optional second roller 30 can be mounted just like the first roller 20 on the opposite traverse member 12 from the first roller 20. This optional second roller 30 could have different dimensions than the first roller 20 or could be located higher or lower than the first roller 20 to provide a user two different rolling options in one device. Either way, the second roller 30 is not required to practice the invention.

While the invention has been described by means of specific embodiments, modifications and variations could be made thereto by those ordinarily skilled in the art without departing from the scope and spirit of the invention set forth in the claims. Likewise, the invention is not limited in its operational application to the above details of mechanical angular and special relationships, users biomechanical positioning, various extremity force producing embodiments and of being practiced or of being potentially operationally carried out in various other ways. The phraseology and terminology used herein is for the purpose of description and should not be regarded as limiting. Unless specified or limited otherwise, the terms "supported," and "coupled" and variations thereof are used broadly and encompass both direct and indirect operational possibilities.

What is claimed is:

1. A spine rolling apparatus comprising, a frame, the frame comprising a first transverse member, a second transverse member, and two longitudinal members, the two longitudinal members located completely above the first and second transverse members in use and first ends of the two longitudinal members extending from the first transverse member in a first plane and second ends of the two longitudinal members extending from the second transverse member in the first plane, and a roller assembly rigidly supported from below by the first transverse member, the roller assembly comprising a roller and a roller support, the roller support located between the first transverse member and the roller, the roller support connected to a middle of the first transverse member, the roller comprising a fixed axis of rotation, parallel to a longitudinal axis of the first transverse member.

2. The apparatus of claim 1, the roller comprising a center channel oriented on a circumference of the roller.

3. The apparatus of claim 2, the roller comprising a width no greater than four inches.

4. The apparatus of claim 1, the longitudinal members are connected to a top face of the first transverse member to create a space underneath the longitudinal members.

5. The apparatus of claim 1, the frame further comprising a joint between the first transverse member and a first longitudinal member of the longitudinal members, the joint comprising a hinge to permit the first transverse member to rotate relative to the first longitudinal member for storing the apparatus.

6. The apparatus of claim 1, wherein the first transverse member is detachably connected to a longitudinal member of the longitudinal members to permit the frame to be temporarily disconnected for storing the apparatus.

7. The apparatus of claim 1, wherein the first transverse member or a longitudinal member of the longitudinal members are telescoping members so that the size of the frame can be reduced for storing the apparatus.

* * * * *